US011237498B2

(12) United States Patent
Gofuku

(10) Patent No.: US 11,237,498 B2
(45) Date of Patent: Feb. 1, 2022

(54) IMAGE FORMING APPARATUS INCLUDING A MOVEMENT MECHANISM FOR MOVING A TONER CONTAINER THAT IS REPLACEABLE

(71) Applicant: CANON KABUSHIKI KAISHA, Tokyo (JP)

(72) Inventor: Shuichi Gofuku, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/093,053

(22) Filed: Nov. 9, 2020

(65) Prior Publication Data

US 2021/0149323 A1 May 20, 2021

(30) Foreign Application Priority Data

Nov. 14, 2019 (JP) ..... JP2019-206345

(51) Int. Cl.
*G03G 15/00* (2006.01)
*G03G 21/16* (2006.01)
*G03G 15/08* (2006.01)

(52) U.S. Cl.
CPC ..... *G03G 15/0865* (2013.01); *G03G 15/0808* (2013.01); *G03G 15/556* (2013.01); *G03G 21/1633* (2013.01); *G03G 21/1676* (2013.01); *G03G 2215/066* (2013.01)

(58) Field of Classification Search
CPC ..... G03G 15/0808; G03G 15/0865; G03G 15/553; G03G 21/1647; G03G 21/1676; G03G 2215/066; G03G 2221/163; G03G 15/0875; G03G 15/556; G03G 21/1633
See application file for complete search history.

(56) References Cited

U.S. PATENT DOCUMENTS

2011/0058825 A1* 3/2011 Tsukijima ..... G03G 21/1676 399/27
2011/0280593 A1* 11/2011 Kanakubo ..... G03G 15/553 399/27
2014/0140725 A1* 5/2014 Kawasumi ..... G03G 15/0879 399/119
2021/0080867 A1* 3/2021 Goto ..... G03G 15/0877

FOREIGN PATENT DOCUMENTS

JP 5307200 B2 10/2013

* cited by examiner

*Primary Examiner* — Sophia S Chen
(74) *Attorney, Agent, or Firm* — Canon U.S.A., Inc. I.P. Division

(57) ABSTRACT

An image forming apparatus includes a toner container, and a main body which the toner container is attachable to and detachable from. The main body includes an image forming unit including a photosensitive drum, a toner containing portion, and a development roller, an attaching portion in which the toner container is at a first position for allowing supply of the toner, an opening portion of the main body, an acquisition unit acquiring a correlation value correlating with a toner remaining amount, an opening/closing member moving between an open position and a closed position, a detection unit detecting the opening/closing member, a movement mechanism executing moving operation for moving the toner container from the first position to a second position, and a control unit controlling the movement mechanism to execute the moving operation in a case where both of a first condition and a second condition are satisfied.

15 Claims, 11 Drawing Sheets

IMAGE FORMING APPARATUS INCLUDING A MOVEMENT MECHANISM FOR MOVING A TONER CONTAINER THAT IS REPLACEABLE

BACKGROUND

Field of the Disclosure

The present disclosure generally relates to an electrophotographic image forming apparatus such as a printer, a copy machine, or a facsimile machine.

Description of the Related Art

As an electrophotographic image forming apparatus, there is known an image forming apparatus having a configuration in which a toner container is attachable to and detachable from the main body of the image forming apparatus in a state where process members such as a photosensitive drum and a development roller are in the main body. In the image forming apparatus having such a configuration, only the toner container can be replaced in a case where toner runs out, so that image formation can be performed.

Meanwhile, Japanese Patent No. 5307200 discusses a configuration in which a message for prompting a user to replace a toner container is displayed on a display unit, and the toner container is moved to a take-out position in response to a selection of the message by the user when a toner container is to be replaced.

In the configuration discussed in Japanese Patent No. 5307200, the user needs to perform an operation for selecting the message in order to replace the toner container.

SUMMARY

According to an aspect of the present disclosure, an image forming apparatus includes a toner container configured to contain toner, and a main body which the toner container is attachable to and detachable from. The main body includes an image forming unit including a photosensitive drum configured to bear a toner image, a toner containing portion configured to contain the toner supplied from the toner container, and a development roller configured to bear the toner contained in the toner containing portion and to supply the toner to the photosensitive drum, an attaching portion to which the toner container is attachable and in which the toner container is at a first position for allowing supply of the toner to the toner containing portion in a state where attachment of the toner container at the attaching portion is completed, an opening portion through which the toner container passes when the toner container is attached at the attaching portion, an acquisition unit configured to acquire a correlation value that correlates with a toner remaining amount of the toner container, an opening/closing member configured to move between an open position for opening the opening portion and a closed position for covering the opening portion, a detection unit configured to detect the opening/closing member at the open position, a movement mechanism configured to perform a moving operation for moving the toner container from the first position to a second position, downstream from the first position in a detachment direction, for detaching the toner container from the attaching portion, and a control unit configured to control the movement mechanism to execute the moving operation in a case where both of a first condition and a second condition are satisfied and not to execute the moving operation in a case where at least one of the first condition and the second condition is not satisfied, wherein the first condition is that a predetermined condition is satisfied by the correlation value, and the second condition is that the opening/closing member at the open position is detected by the opening/closing detection unit.

Further features of the present disclosure will become apparent from the following description of exemplary embodiments with reference to the attached drawings.

DESCRIPTION OF THE EMBODIMENTS

Figure 2:
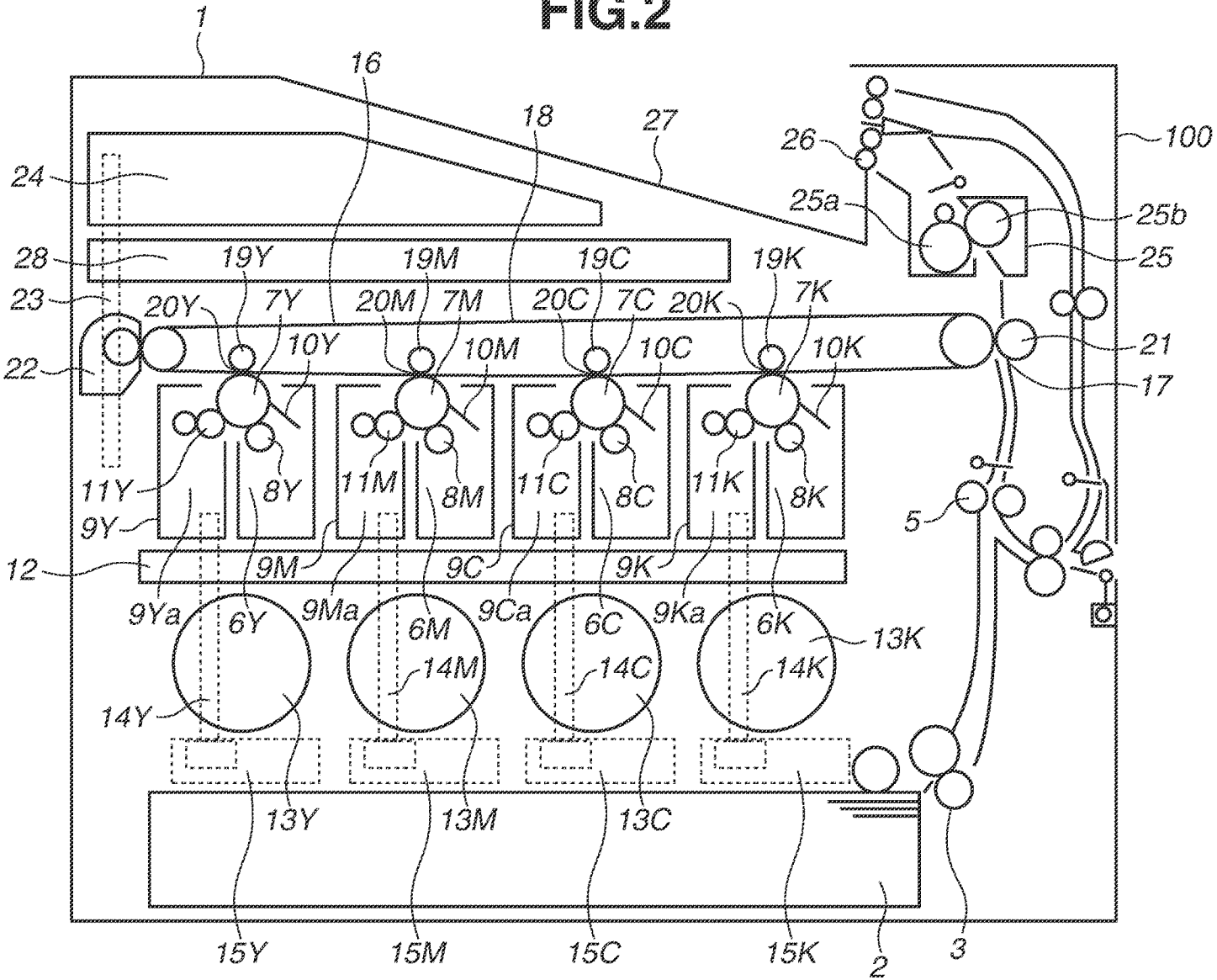
FIG. 2 is a main cross-section diagram illustrating an overall configuration of an image forming apparatus according to the first exemplary embodiment.

An image forming apparatus 1 according to a first exemplary embodiment of the present disclosure will be described. FIG. 2 is a main cross-section diagram illustrating an overall configuration of a main body 100 of the image forming apparatus 1. A cassette 2 is withdrawably stored in a lower part of the main body 100. A cassette feed unit 3 is arranged at a near end of the cassette 2. Transfer media are stacked in the cassette 2, and are separated and fed one by one to a registration roller 5.

The main body 100 includes image forming units 6Y, 6M, 6C, and 6K (collectively referred to as image forming unit 6) arranged side by side and corresponding to yellow, magenta, cyan, and black, respectively. The image forming units 6Y, 6M, 6C, and 6K include photosensitive drums 7Y, 7M, 7C, and 7K, respectively, as image bearing members. The image forming units 6Y, 6M, 6C, and 6K further include charging devices 8Y, 8M, 8C, and 8K, respectively. The charging devices 8Y, 8M, 8C, and 8K each uniformly charge the surface of the corresponding one of the photosensitive drums 7Y, 7M, 7C, and 7K. The image forming units 6Y, 6M, 6C, and 6K further include development devices 9Y, 9M, 9C, and 9K, respectively. The development devices 9Y, 9M, 9C, and 9K each develop a toner image by attaching toner to an electrostatic latent image. Hereinafter, the photosensitive drums 7Y to 7K may be referred to as a photosensitive drum 7, the charging devices 8Y to 8K may be referred to as a charging device 8, and the development devices 9Y to 9K may be referred to as a development device 9. The image forming units 6Y, 6M, 6C, and 6K further include photosensitive member cleaning blades 10Y, 10M, 10C, and 10K (collectively referred to as photosensitive member cleaning blade 10), respectively. The photosensitive member cleaning blade 10 removes toner remaining on the photosensitive drum 7. The development devices 9Y, 9M, 9C, and 9K include development rollers 11Y, 11M, 11C, and 11K (collectively referred to as development roller 11), respectively, corresponding to the respective colors and configured to abut on and separate from the respective photosensitive drums 7. The development devices 9Y, 9M, 9C, and 9K include toner containing portions 9Ya, 9Ma, 9Ca, and 9Ka (collectively referred to as toner containing portion 9*a*), respectively. The toner containing portion 9*a* contains toner to be borne by the development roller 11. A scanner unit 12 is disposed below the image forming unit 6, and forms an electrostatic latent image on the photosensitive drum 7 by irradiating the photosensitive drum 7 with a laser beam based on image information.

Attaching portions 101Y, 101M, 101C, and 101K (collectively referred to as attaching portion 101) are arranged between the scanner unit 12 and the cassette 2. Toner containers 13Y, 13M, 13C, and 13K (collectively referred to as toner container 13) can each be attached to the corresponding attaching portion 101, in a substantially horizontal manner. The toner container 13 contains replenishment toner of corresponding color, and a stirring member (conveyance member) 130 (see FIGS. 3A and 3B) that stirs (conveys) the toner. Toner vertical conveyance units 14Y, 14M, 14C, and 14K (collectively referred to as toner conveyance unit 14) each receive the toner from the toner container 13, and supply the received toner to the toner containing portion 9*a* of the development device 9 by conveying the toner upward. The toner container 13 and the toner conveyance unit 14 are driven by the corresponding one of toner conveyance drive units 15Y, 15M, 15C, and 15K (the toner conveyance drive unit 15) disposed below the toner conveyance unit 14.

An intermediate transfer unit 16 is arranged above the development device 9. The intermediate transfer unit 16 is arranged in a substantially horizontal manner, with the lower side being on the primary transfer side. An intermediate transfer belt 18 facing each of the photosensitive drums 7 is a rotatable endless belt, and is stretched around a plurality of stretching rollers. Primary transfer rollers 19Y, 19M, 19C, and 19K (collectively referred to as primary transfer roller 19) are arranged on an inner surface of the intermediate transfer belt 18, and form primary transfer portions 20Y, 20M, 20C, and 20K (collectively referred to as primary transfer portion 20) with the photosensitive drums 7Y, 7M, 7C, and 7K, respectively, with the intermediate transfer belt 18 therebetween. At each of the primary transfer portions 20, a toner image is transferred from the corresponding photosensitive drum 7 to the intermediate transfer belt 18 by the corresponding primary transfer roller 19 to which a voltage is applied. In the present exemplary embodiment, the intermediate transfer unit 16 including the intermediate transfer belt 18, the plurality of stretching rollers for stretching the intermediate transfer belt 18, and each of the primary transfer rollers 19 is configured to be attachable to and detachable from the main body 100.

A secondary transfer roller 21 that is a secondary transfer member is in contact with the intermediate transfer belt 18 and forms a secondary transfer portion 17 with an opposing roller, with the intermediate transfer belt 18 therebetween. The toner image transferred onto the intermediate transfer belt 18 is secondarily transferred to the transfer medium at the secondary transfer portion 17. A cleaning unit 22 removes the toner remaining on the intermediate transfer belt 18 without being transferred to the transfer medium by the secondary transfer. The toner removed by the cleaning unit 22 is conveyed to a toner collecting container 24 via a toner conveyance unit 23 and is accumulated therein.

Then, the transfer medium is conveyed to a fixing device 25 and passes through a nip formed by a heating unit 25*a* and a pressing roller 25*b* in pressure contact with the heating unit 25*a* included in the fixing device 25. Upon passing through the fixing device 25, the transfer medium is conveyed to a discharge roller pair 26 and discharged thereby to a stack portion 27.

A low-voltage power supply device (not illustrated) is disposed on the back side of the main body 100, and supplies voltage to actuators such as various motors, fans, and solenoids in the main body 100. A high-voltage power supply device 28 is arranged in a space between the intermediate transfer belt 18 and the toner collecting container 24, and applies high voltages to components such as the charging device 8, the development device 9, the primary transfer roller 19, and the secondary transfer roller 21.

<Attachment and Detachment of Toner Container in and from Main Body>

Figure 3A:
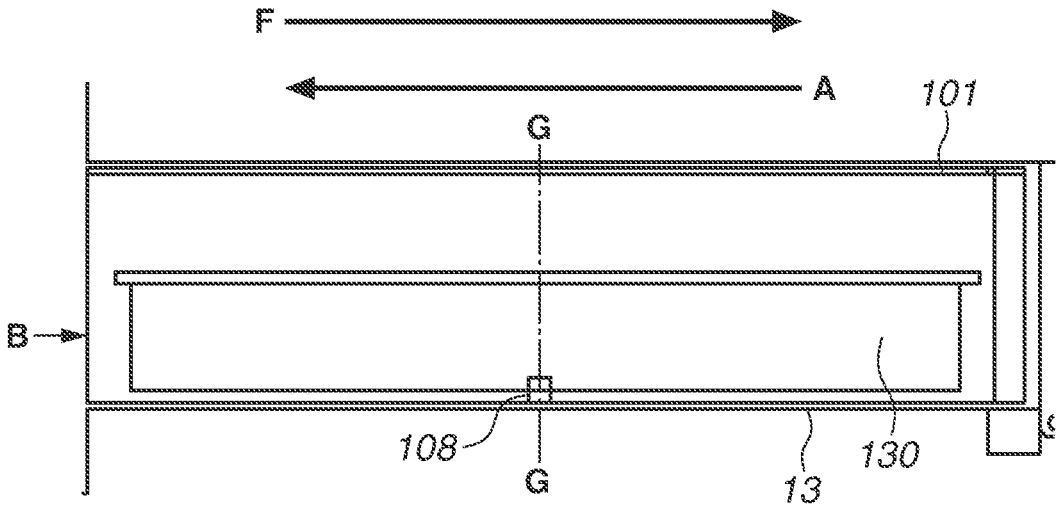
FIGS. 3A and 3B are diagrams illustrating a state where the toner container is stored according to the first exemplary embodiment.
Figure 3B:
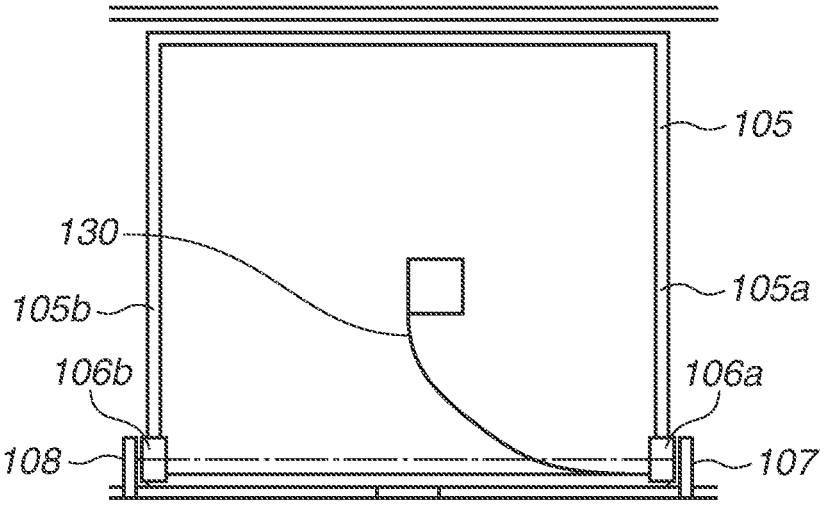

FIG. 3A illustrates a state where the toner container 13 is attached to the attaching portion 101, and FIG. 3B illustrates a cross-section of the toner container 13 taken along a line G. A position at which attachment of the toner container 13 is completed is an attachment completion position B (first position). The first position is a position that allows conveyance (supply) of the toner from the toner container 13 illustrated in FIG. 2 to the toner containing portion 9*a* of the development device 9, using the toner conveyance unit 14. In other words, the first position is a position that allows the toner containing portion 9*a* to receive toner from the toner container 13.

The toner container 13 can pass through an opening portion 101*a* (FIG. 4C) between the scanner unit 12 and the cassette 2 to be attached to and detached from the attaching portion 101. A direction in which the toner container 13 is attached to the attaching portion 101 is an attachment direction A, and a direction in which the toner container 13 is withdrawn from the attaching portion 101 is a withdrawal direction F (detachment direction). A door (opening/closing member) 102 (see FIGS. 4A to 4C) that covers the opening portion 101*a* is arranged on the withdrawal direction F side. The door 102 is configured to move between a closed position for covering the opening portion 101*a* of the main body 100 and an open position for opening (not covering) the opening portion 101*a*. The door 102 can open and close to uncover and cover all of opening portions 101Ya, 101Ma, 101Ca, and 101Ka (FIG. 6A) corresponding to the toner containers 13Y, 13M, 13C, and 13K, respectively.

Figure 4A:
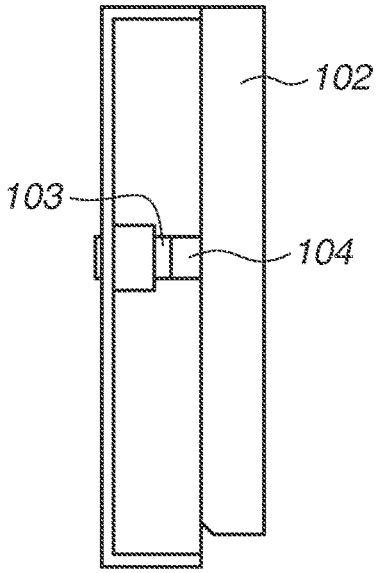
FIGS. 4A to 4C are diagrams illustrating a door opening/closing detection method according to the first exemplary embodiment.
Figure 4B:
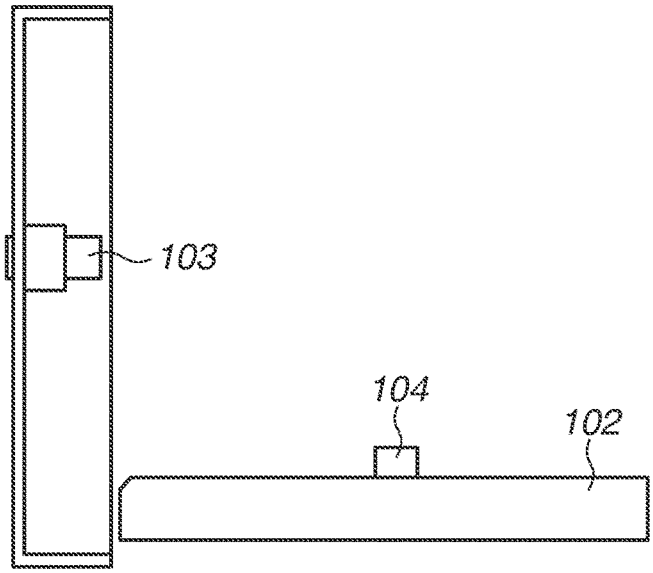
Figure 4C:
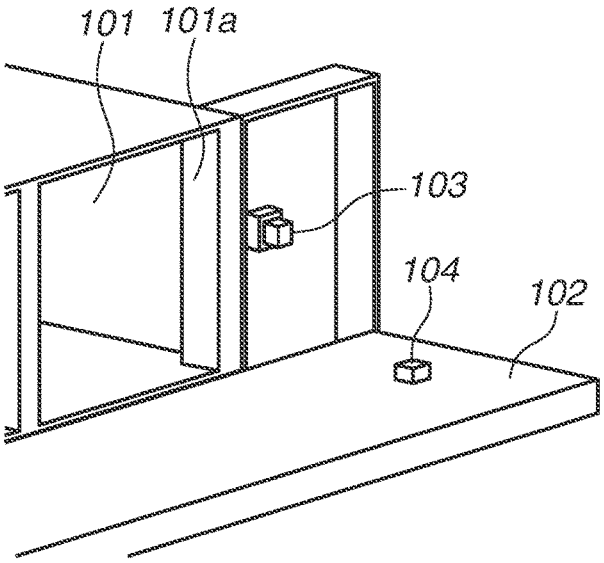
Figure 11:
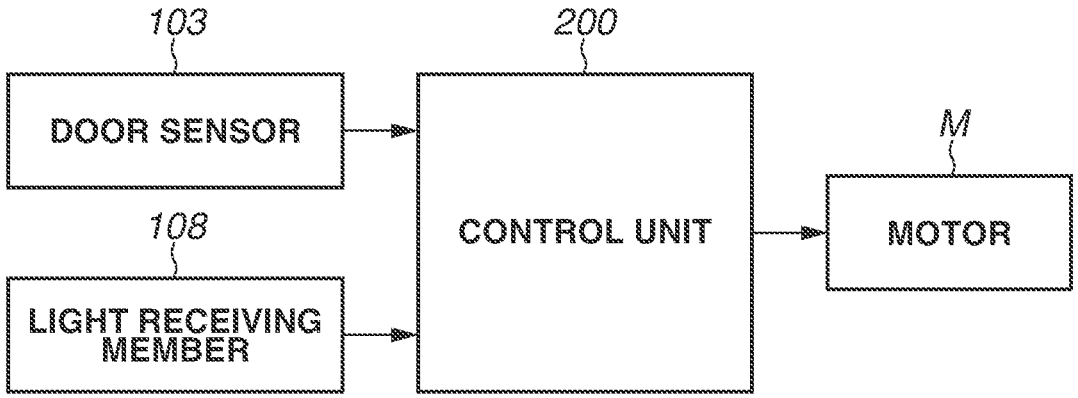
FIG. 11 is a control block diagram according to the first to third exemplary embodiments.

FIG. 4A is a cross-sectional diagram illustrating the door 102 and a portion near the door 102 when the door 102 in the closed position. FIGS. 4B and 4C are a cross-sectional diagram and a perspective diagram, respectively, each illustrating the door 102 and the portion near the door 102 when the door 102 is at the open position. A door sensor 103 serving as an opening/closing detection unit for detecting opening/closing of the door 102 is disposed in the main body 100. When the door 102 is at the closed position, a protrusion 104 provided on the door 102 is in contact with the door sensor 103, so that the door 102 in the closed position is detected. When the door 102 is at the open position, the protrusion 104 is away from the door sensor 103, so that the door 102 in the open position is detected. FIG. 11 is a control block diagram for controlling the operation described above by a control unit 200. The door sensor 103 transmits a detection signal to the control unit 200 illustrated in FIG. 11.

<Toner Remaining Amount Detection>

Next, a toner remaining amount detection method for the toner container 13 of the present exemplary embodiment will be described. In the present exemplary embodiment, light transmission-type toner remaining amount detection is employed. The light transmission-type toner remaining amount detection is a method of detecting a remaining amount of toner contained in the toner container 13, based on a transmission duration time during which detection light passes through the toner container 13. The stirring member 130 stirs toner by rotating in the toner container 13, and the transmission duration time of the detection light is measured for each rotation period of the stirring member 130. The detection light does not pass through the toner container 13 in a state where a large amount of toner is in the toner container 13, and the detection light passes through the toner container 13 as the toner is consumed. In this way, the time period during which the detection light is detected increases with the toner consumption, and this is used for the detection of the toner remaining amount.

More specifically, as illustrated in FIG. 3B, a light transmission member 106*a* and a light transmission member 106*b* are arranged at a wall 105*a* on one end side and a wall 105*b* on the other end side opposing the one end side, respectively, of a frame 105 of the toner container 13. A light emission member 107 is arranged at a position facing the light transmission member 106*a* of the toner container 13 attached to the attaching portion 101 of the main body 100, and a light receiving member 108 is arranged at a position facing the light transmission member 106*b*. The light receiving member 108 is arranged to be able to receive light emitted from the light emission member 107 and passing through the light transmission members 106*a* and 106*b*, in a case where there is no toner in the toner container 13. In a case where the toner remaining amount of the toner container 13 is large, the light receiving member 108 does not receive the light or the time period during which the light receiving member 108 receives the light is reduced, because the light emitted from the light emission member 107 is blocked by the toner between the light transmission members 106*a* and 106*b*. When the toner remaining amount of the toner container 13 decreases, the toner existing between the light transmission members 106*a* and 106*b* also decreases, so that the time period during which the light receiving member 108 receives the light emitted by the light emission member 107 increases. In other words, the time period during which the light receiving member 108 receives the light emitted by the light emission member 107 is a correlation value that correlates with the toner remaining amount of the toner container 13. The control unit 200 illustrated in FIG. 11 as an acquisition unit acquires an output value (detection time period) of the light receiving member 108. The control unit 200 determines whether replacement of the toner container 13 is required, depending on whether a predetermined condition that the output value (detection time period) of the light receiving member 108 exceeds a predetermined value (predetermined time period) is satisfied.

In the present exemplary embodiment, the light transmission-type detection method is used for the toner remaining amount detection, but any other method may be used if the method uses a correlation value that correlates with the toner remaining amount of the toner container 13. For example, there may be used a method of measuring the weight (correlation value) of the toner container 13 that varies depending on the toner remaining amount, or a method of detecting capacitance (correlation value) between electrodes that varies depending on the toner remaining amount.

Further, a method of estimating the toner remaining amount from image information such as a pixel count may be used. The method using the pixel count is a method of calculating a toner remaining amount estimated value by subtracting a toner consumption amount that is calculated by multiplying a toner amount consumed by one pixel by the number of black pixels (correlation value) of a video signal, from a toner amount in a state where a cartridge is not used. Furthermore, as a toner remaining amount estimation method using information other than the pixel count, the total number of rotations or the total rotation amount of the stirring member (conveyance member) 130 arranged in the toner container 13 can be used as the correlation value for the toner remaining amount.

<Movement Mechanism for Toner Container>

Figure 5:
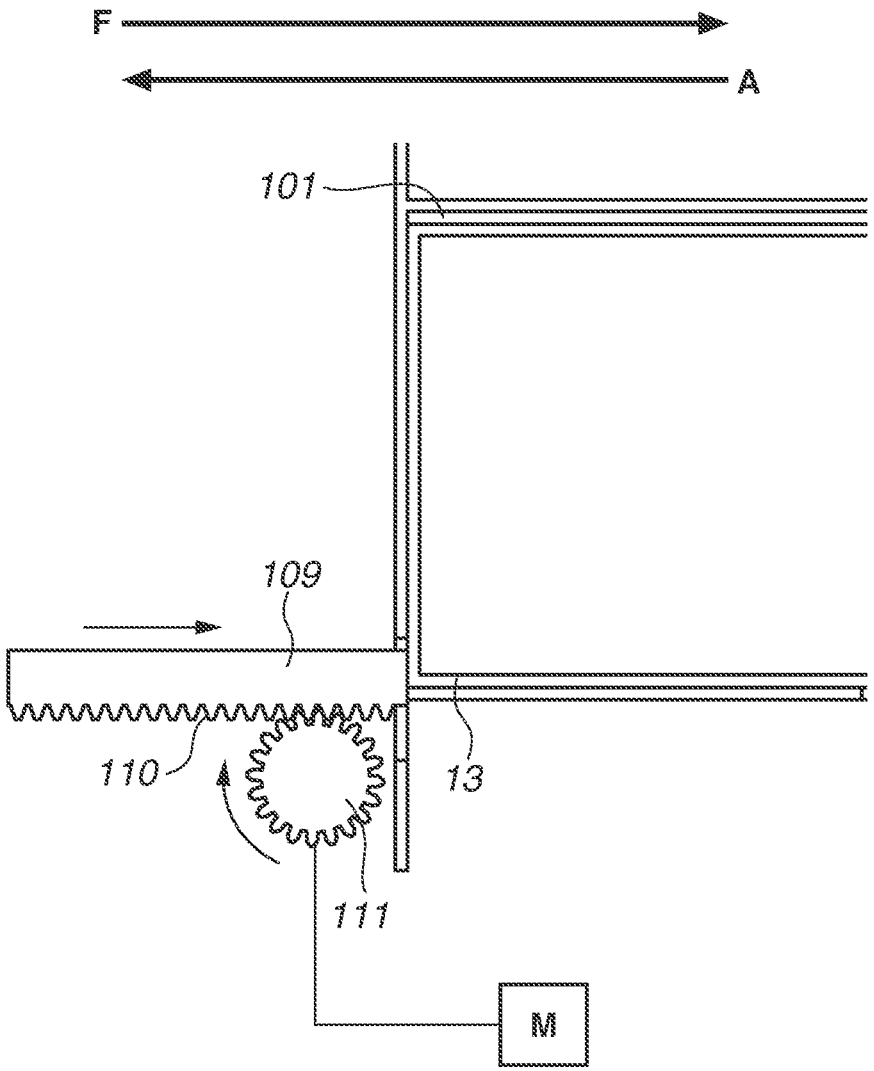
FIG. 5 is a diagram illustrating a state where the toner container is moved by a movement mechanism according to the first exemplary embodiment.

A mechanism for moving the toner container 13 from the attachment completion position B (first position) illustrated in FIGS. 3A and 3B to a withdrawal position (second position) will be described with reference to FIG. 5. The toner container 13 is pressed by a moving member 109 and to move to the second position on the downstream side in the withdrawal direction F. The moving member 109 is moved by the engagement of a moving rack 110 arranged on the moving member 109 and a moving gear 111 rotated by the positive rotation of a motor M. The movement mechanism includes the moving member 109, the moving rack 110, the moving gear 111, and the motor M.

After the toner container 13 is moved in the withdrawal direction F, the rotation of the motor M is reversed to move the moving member 109 in the attachment direction A so that the toner container 13 can be attached.

The control unit 200 in FIG. 11 controls the ON/OFF state, the rotation direction, and the rotation speed of the motor M. In other words, the control unit 200 can execute moving operation for moving the toner container 13 from the first position to the second position by controlling the motor M.

<Condition for Moving Toner Container>

In the present exemplary embodiment, in a case where the toner remaining amount of the toner container 13 is large, operation of supplying toner in the toner container 13 to the development device 9 continues. In a case where the toner remaining amount of the toner container 13 is small, information indicating that replacement of the toner container 13 is required is displayed on a panel (not illustrated) provided on the main body 100. In a product form without a panel, a user may be prompted to replace the toner container 13 by turning on of a light emitting diode (LED) (not illustrated).

Figure 1:
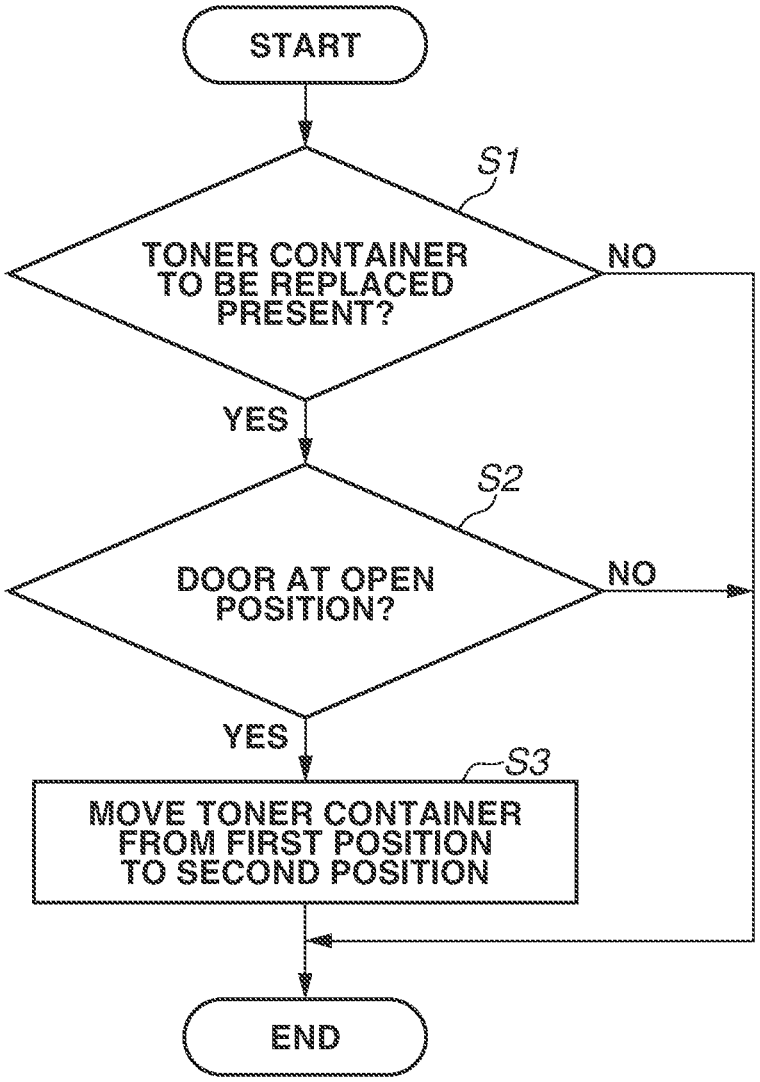
FIG. 1 is a flowchart illustrating a control for moving a toner container according to a first exemplary embodiment.
Figure 6A:
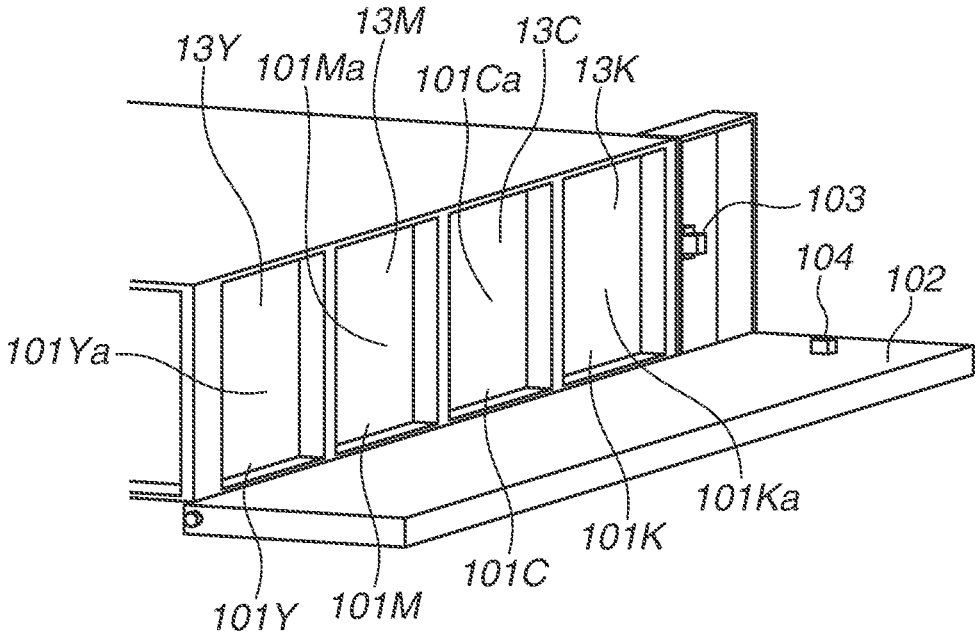
FIGS. 6A and 6B are diagrams illustrating a relationship between the toner container and a storage opening according to the first exemplary embodiment.
Figure 6B:
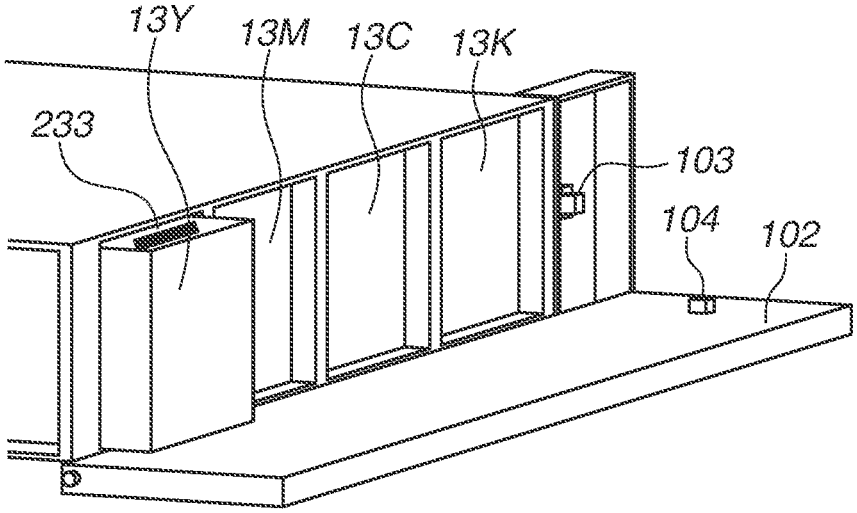

FIG. 1 is a flowchart illustrating an operation regarding the movement of the toner container 13. FIG. 6A is a perspective diagram illustrating the toner container 13 located at the attachment completion position B (first position). FIG. 6B is a perspective diagram illustrating the toner container 13 located at the second position.

As illustrated in FIG. 1, in step S1, the control unit 200 determines whether the toner container 13 to be replaced is present, based on the toner remaining amount of the toner container 13 detected by the toner remaining amount detection. If the toner container 13 to be replaced is present (YES in step S1), the operation proceeds to step S2. In step S2, the control unit 200 determines whether the door 102 is at the open position, based on detection by the door sensor 103. If the door 102 is at the open position (YES in step S2), the operation proceeds to step S3. In step S3, the movement mechanism moves the toner container 13 in the withdrawal direction F. If the determination result is NO in at least one of step S1 and step S2, the movement mechanism does not move the toner container 13. In other words, in the present exemplary embodiment, the control unit 200 controls the movement mechanism to move the toner container 13 from the first position to the second position, in a case where both of a first condition that the toner container 13 is to be replaced and a second condition that the door 102 is at the open position are satisfied. In a case where at least one of the first condition and the second condition is not satisfied, the control unit 200 controls the movement mechanism not to move the toner container 13. In the present exemplary embodiment, the first condition is that the light receiving time period of the light receiving member 108 is longer than a predetermined time period, and the second condition is that the door 102 is at the open position is detected by the door sensor 103. The above-described control produces such an effect that the user can visually and intuitively recognize the toner container 13 to be replaced because the toner container 13 to be replaced moves from the first position to the second position in the attaching portion 101. In particular, even in an image forming apparatus without a display unit (operation panel), the toner container 13 to be replaced can be recognized. Further, because the second position is located downstream of the first position in the withdrawal direction F, the user can easily hold the toner container 13 and thus can readily perform replacement work.

After moving the toner container 13 by moving in the withdrawal direction F, the moving member 109 moves in the attachment direction A to be in the state where the toner container 13 can be inserted again.

In this case, in FIG. 6B, the toner container 13Y is at the second position, and each of the toner containers 13M, 13C, and 13K is at the first position. The toner container 13Y at the second position can be easily withdrawn because a handle 233 is exposed outside the main body 100. The handle 233 of each of the toner containers 13M, 13C, and 13K at the first position is not exposed outside the main body 100, and thus the user can be prevented from withdrawing the cartridge by mistake and can also recognize that the toner remains.

A second exemplary embodiment of the present disclosure will be described. The second exemplary embodiment is different from the first exemplary embodiment in that a restriction member 112 that restricts the movement of the toner container 13 in the withdrawal direction F is included.

Figure 7A:
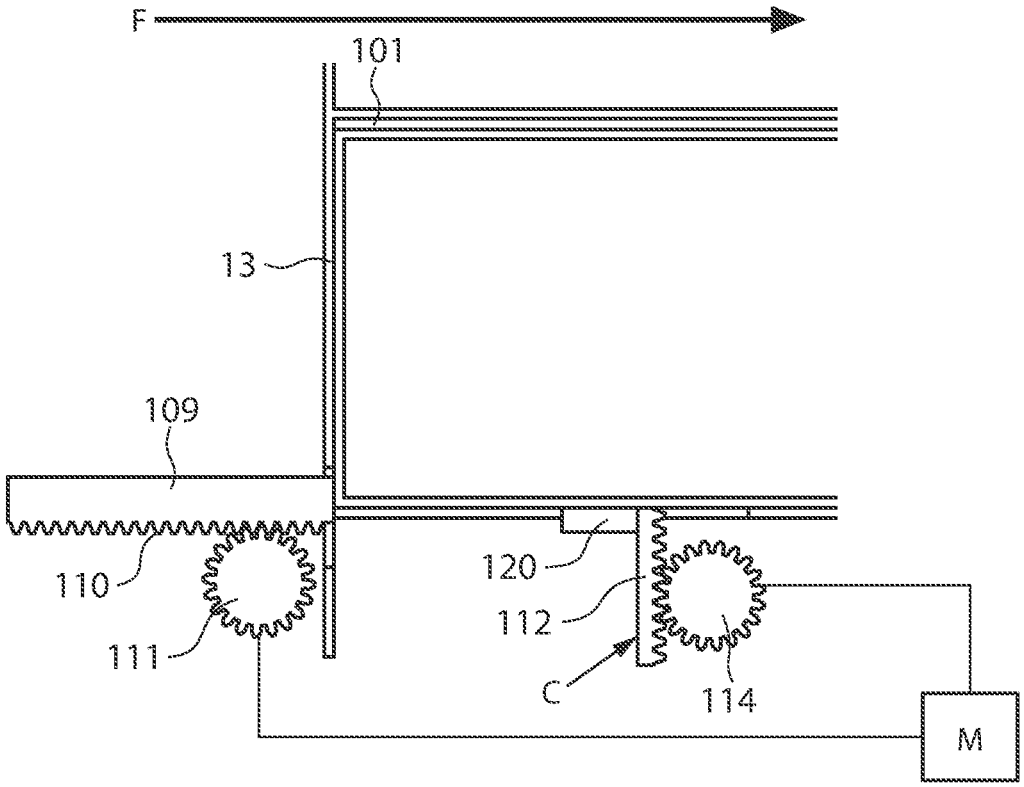
FIGS. 7A and 7B are diagrams illustrating a method of moving a restriction member according to a second exemplary embodiment.
Figure 7B:
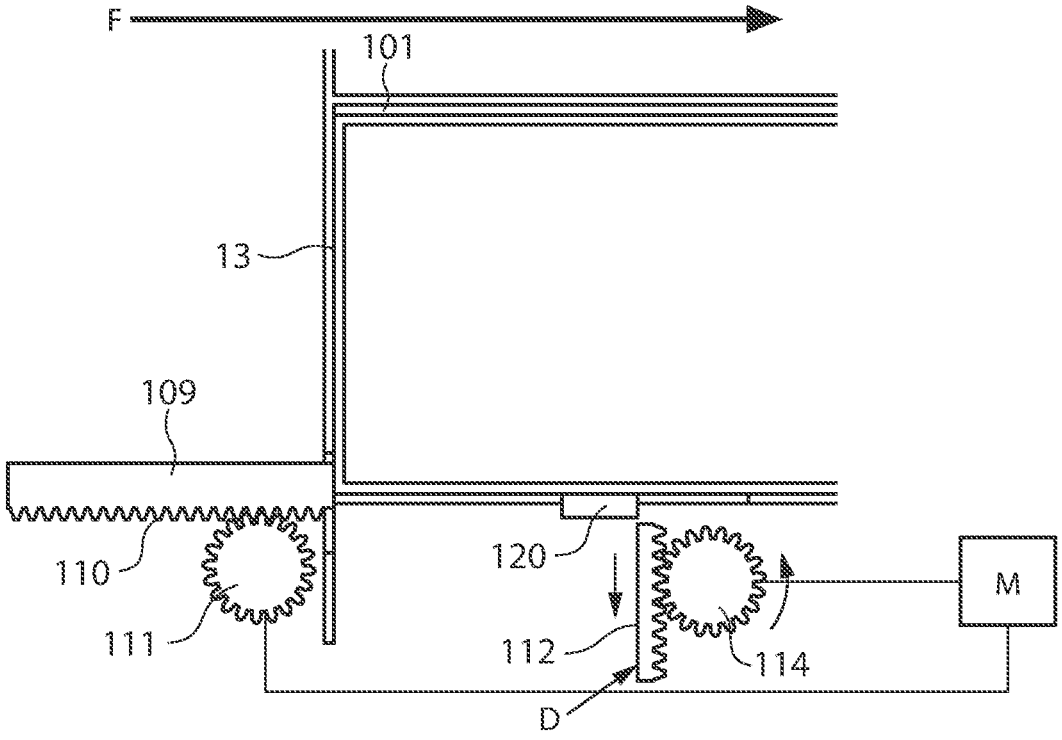

FIG. 7A illustrates a state where the restriction member 112 is at a restriction position C, and FIG. 7B illustrates a state where the restriction member 112 is at a non-restriction position D. The restriction member 112 moves between the restriction position C and the non-restriction position D by engaging with a restriction gear 114 driven by the rotation of the motor M. The movement of the toner container 13 from the first position in the withdrawal direction F is restricted at the restriction position C (FIG. 7A), and the movement of the toner container 13 is not restricted at the non-restriction position D (FIG. 7B).

Upon moving to the restriction position C, the restriction member 112 engages with an engaged portion 120 provided on the toner container 13. In this way, the movement of the toner container 13 in the withdrawal direction F is restricted. When the toner container 13 is withdrawn, the restriction member 112 moves to the non-restriction position D at which the restriction member 112 is not in contact with the engaged portion 120, so that the toner container 13 can be withdrawn.

The restriction member 112 moves to the restriction position C or the non-restriction position D, depending on the result of detecting the toner remaining amount of the toner container 13. The restriction member 112 moves to the restriction position C in a state where there is toner remaining in the toner container 13, and moves to the non-restriction position D if there is no remaining toner or if a toner remaining amount of the toner container 13 is less than a predetermined amount. When the toner container 13 is attached and is at the first position again, the restriction member 112 moves from the non-restriction position D to the restriction position C to restrict the movement of the toner container 13.

Thus, by providing the restriction member 112, the withdrawal of the toner container 13 can be restricted in a state where there is toner in the toner container 13, and the withdrawal of the toner container 13 is allowed in a state where there is no toner in the toner container 13.

Figure 8:
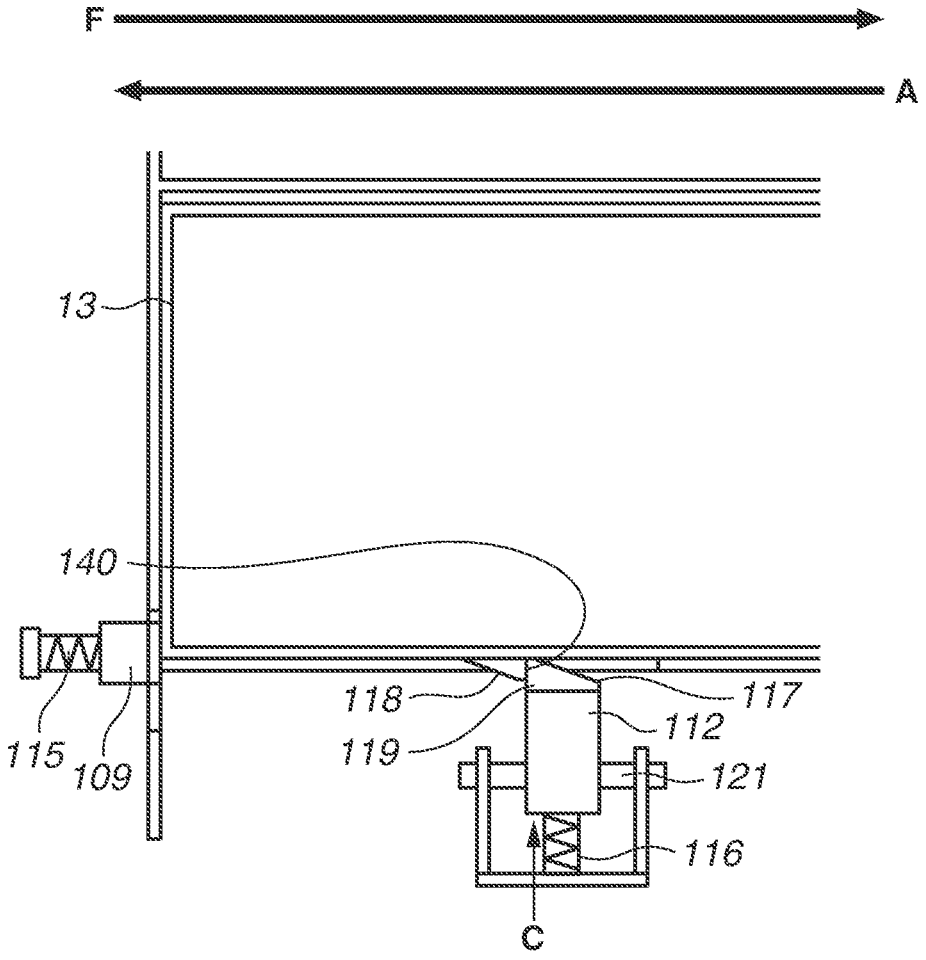
FIG. 8 is a diagram illustrating a state where a toner container is attached and is at an attachment completion position according to a third exemplary embodiment.

In a third exemplary embodiment, a modification example of the movement mechanism and the restriction member described in the first and second exemplary embodiments will be described. In FIG. 8, the toner container 13 is urged in the withdrawal direction F (direction from first position toward second position) by a first elastic member (urging member) 115 via a moving member 109 that is in contact with the toner container 13.

A restriction member 112 moves between a restriction position C for restricting the movement of the toner container 13 in the withdrawal direction F by resisting an urging force of a first elastic member 115, and a non-restriction position (permission position) D for permitting the movement of the toner container 13 in the withdrawal direction F.

The restriction member 112 is urged by a second elastic member 116, in a direction intersecting the attachment direction A and toward the restriction position C.

Figure 9A:
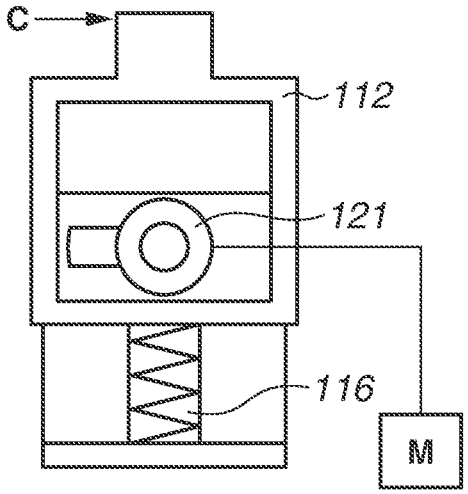
FIGS. 9A and 9B are diagrams illustrating how a restriction member moves from a restriction position to a non-restriction position according to the third exemplary embodiment.
Figure 9B:
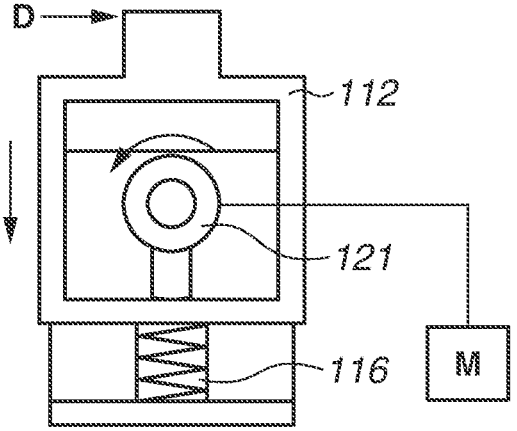

FIGS. 9A and 9B illustrate phases of a release cam 121 in a state where the restriction member 112 is at the restriction position C and at the non-restriction position D, respectively. The control unit 200 in FIG. 1 drives the motor M to rotate the release cam 121, so that the restriction member 112 moves from the restriction position C to the non-restriction position D.

As illustrated in FIG. 8, the restriction member 112 and the toner container 13 each extend in a direction intersecting the withdrawal direction F, and have an engaging surface 119 and an engaged surface 140, respectively. The engaging surface 119 and the engaged surface 140 are configured to engage with each other. The movement of the toner container 13 in the withdrawal direction F is restricted by the engagement of the engaging surface 119 of the restriction member 112 and the engaged surface 140 of the toner container 13.

When the restriction member 112 is moved to the non-restriction position D by the rotating the release cam 121, the moving member 109 presses the toner container 13 by using the urging force of the first elastic member 115, so that the toner container 13 moves in the withdrawal direction F. The toner container 13 is thereby moved from the first position to the second position, so that the toner container 13 can be withdrawn. After the toner container 13 is withdrawn, the release cam 121 is rotated by the driving force of the motor M, so that the restriction member 112 is moved to the restriction position C by the urging force of the second elastic member 116.

Next, a case where the toner container 13 is attached to the attaching portion 101 in a state where the restriction member 112 is at the restriction position C will be described.

Figure 10A:
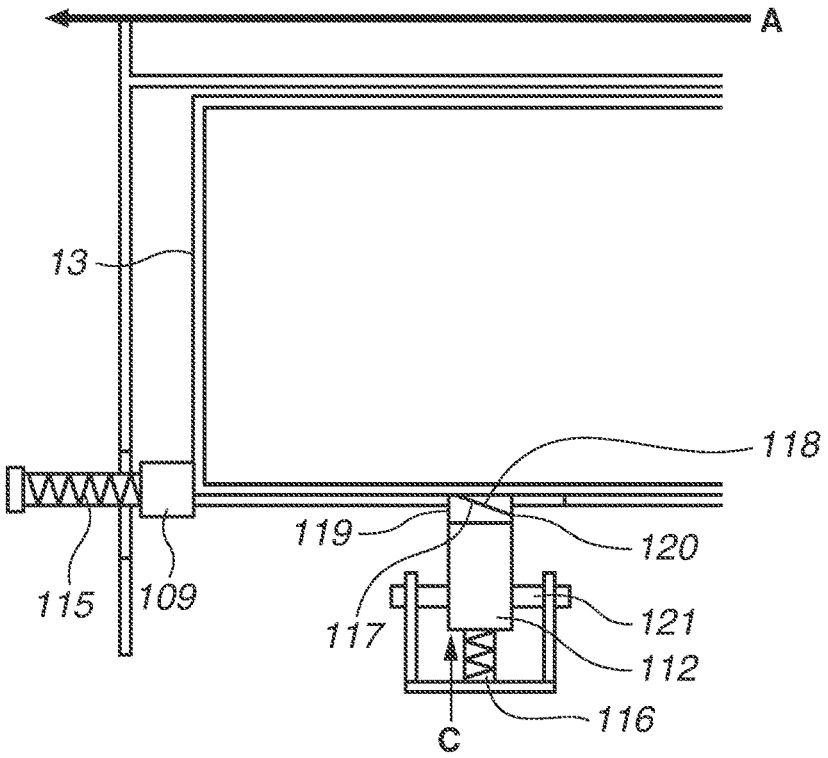
FIGS. 10A and 10B are diagrams illustrating how the restriction member is moved by attaching the toner container according to the third exemplary embodiment.
Figure 10B:
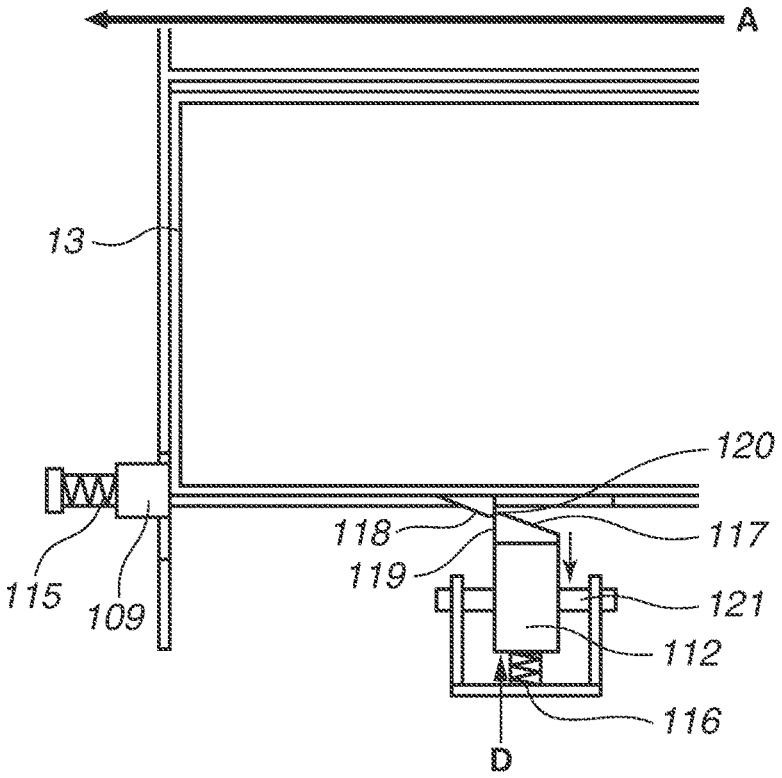

FIG. 10A illustrates a state where the restriction member 112 located at the restriction position C has started coming in contact with the toner container 13. FIG. 10B illustrates a state where the restriction member 112 is pressed down to the non-restriction position D by the movement of the toner container 13 in the attachment direction A. The restriction member 112 has a first inclined surface 117 inclining toward the toner container 13 in the attachment direction A, and the toner container 13 has a second inclined surface 118 inclining toward the restriction member 112 in the direction opposite to the attachment direction A. When the toner container 13 moves in the attachment direction A, the first inclined surface 117 of the restriction member 112 is in contact with the second inclined surface 118 of the toner container 13, so that a force in a direction from the restriction position C toward the non-restriction position D acts on the restriction member 112. Accordingly, the restriction member 112 is moved from the restriction position C to the non-restriction position D by the attachment operation of the toner container 13, so that the toner container 13 can be moved to the first position that is the attachment completion position.

As illustrated in FIG. 8, when the toner container 13 is attached up to the first position, the first inclined surface 117 and the second inclined surface 118 are not in contact with each other. When the toner container 13 is attached up to the first position, the restriction member 112 is moved from the non-restriction position D to the restriction position C by the urging force of the second elastic member 116, so that the movement of the toner container 13 in the withdrawal direction F is restricted.

As a result, when the user inserts the toner container 13 up to the first position, the toner container 13 is restricted by the restriction member 112 and thus cannot be withdrawn, so that the user can readily recognize the completion of the attachment of the toner container 13. This can prevent incomplete attachment of the toner container 13. In addition, in the third exemplary embodiment, the moving member 109 moves from the first position to the second position by using the elastic force of the first elastic member 115, and thus a simple configuration without need to control a drive unit is provided.

Further, in the first to third exemplary embodiments, it is desirable that the control unit 200 controls the movement mechanism to start the movement of the toner container 13 from the first position to the second position after the door 102 is completely opened. More specifically, the control unit 200 starts driving the motor M of the movement mechanism so that the movement of the toner container 13 starts after 0.5 to 2.0 seconds (1.0 second is set in the first to third exemplary embodiments) from the timing at which opening of the door 102 is detected by the door sensor 103. This is to prevent the toner container 13 from colliding with the door 102 moving from the closed position to the open position, when the toner container 13 moves from the first position to the second position. The timing for starting the movement of the toner container 13 may be a timing before the door 102 is completely opened, as long as the toner container 13 does not collide with the door 102 moving from the closed position to the open position.

The disclosure according to the first to third exemplary embodiments is not limited to the toner container, and is applicable to anything attachable to and detachable from the main body, such as the development device and the toner collecting container.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2019-206345, filed Nov. 14, 2019, which is hereby incorporated by reference herein in its entirety.

What is claimed is:

1. An image forming apparatus comprising:

a toner container configured to contain toner; and a main body to which the toner container is attachable and from which the toner container is detachable, the main body including an image forming unit including a photosensitive drum configured to bear a toner image, a toner containing portion configured to contain the toner supplied from the toner container, and a development roller configured to bear the toner contained in the toner containing portion and to supply the toner to the photosensitive drum, an attaching portion to which the toner container is attachable and from which the toner container is detachable, an opening portion through which the toner container passes when the toner container is attached to the attaching portion, an acquisition unit configured to acquire a correlation value that correlates with a toner remaining amount of the toner container, an opening/closing member configured to move between an open position in which the opening/closing member opens the opening portion and a closed position in which the opening/closing member closes the opening portion, a detection unit configured to detect whether the opening/closing member is at the open position or at the closed position, a movement mechanism configured to execute a moving operation for moving the toner container from a first position to a second position, the first position being a position where the toner is supplied from the toner container toward the toner containing portion, the second position being a position downstream from the first position in a detachment direction for detaching the toner container from the attaching portion, and a control unit configured to control the movement mechanism so as to execute the moving operation in a case where both of a first condition and a second condition are satisfied and so as not to execute the moving operation in a case where at least one of the first condition and the second condition is not satisfied, wherein the first condition is a condition in which the correlation value satisfies a predetermined condition, and the second condition is a condition in which the detection unit detects that the opening/closing member is at the open position.

2. The image forming apparatus according to claim 1, wherein the image forming unit, the toner container, and the opening portion are one of a plurality of image forming units, one of a plurality of toner containers, and one of a plurality of opening portions, respectively, and wherein the opening/closing member opens all of the plurality of opening portions in a case where the opening/closing member is at the open position, and closes all of the plurality of opening portions in a case where the opening/closing member is at the closed position.

3. The image forming apparatus according to claim 1, wherein the movement mechanism includes an urging member configured to apply an urging force to the toner container for moving the toner container in the detachment direction, and a restriction member configured to move between a restriction position for restricting movement of the toner container in the detachment direction, and a permission position for permitting the movement of the toner container in the detachment direction, and wherein the moving operation is an operation for moving the restriction member from the restriction position to the permission position and moving the toner container from the first position to the second position by using the urging force.

4. The image forming apparatus according to claim 3, wherein the toner container includes an engaged portion, and wherein the restriction member is configured to move, between the restriction position and the permission position, in a direction intersecting the detachment direction and has an engaging portion, the engaging portion of the restriction member being configured to restrict, at the restriction position, movement of the toner container in the detachment direction by engaging with the engaged portion of the toner container, the engaging portion of the restriction member being configured to permit, at the permission position, the movement of the toner container in the detachment direction by being away from the engaged portion of the toner container.

5. The image forming apparatus according to claim 1, wherein the control unit controls the movement mechanism to move the toner container from the first position to the second position after a predetermined time upon the detection unit detecting that the opening/closing member is at the open position, in a case where the first condition and the second condition are satisfied.

6. The image forming apparatus according to claim 1, wherein the toner container has a handle, wherein the handle is not exposed from the main body in a case where the toner container is at the first position and the opening/closing member is at the open position, and wherein the handle is exposed from the main body in a case where the toner container is at the second position and the opening/closing member is at the open position.

7. The image forming apparatus according to claim 1, wherein when the first condition is satisfied, the toner remaining amount of the toner container is less than a predetermined amount.

8. The image forming apparatus according to claim 1, wherein the detection unit includes a light emission member configured to emit light toward a region in which the toner exits and a light receiving member configured to receive the light emitted from the light emission member, and wherein the correlation value correlates with a time period in which the light receiving member receives the light from the light emission member.

9. The image forming apparatus according to claim 1, wherein the image forming apparatus includes no display unit.

10. An image forming apparatus comprising:

a toner container configured to contain toner; and a main body to which the toner container is attachable and from which the toner container is detachable, the main body including an image forming unit including a photosensitive drum configured to bear a toner image, a toner containing portion configured to contain the toner supplied from the toner container, and a development roller configured to bear the toner contained in the toner containing portion and to supply the toner to the photosensitive drum, an attaching portion to which the toner container is attachable and from which the toner container is detachable, an opening portion through which the toner container passes when the toner container is attached to the attaching portion, an opening/closing member configured to move between an open position in which the opening/closing member opens the opening portion and a closed position in which the opening/closing member closes the opening portion, a movement mechanism configured to execute a moving operation for moving the toner container from a first position to a second position, the first position being a position where the toner is supplied from the toner container toward the toner containing portion, the second position being a position downstream from the first position in a detachment direction for detaching the toner container from the attaching portion, and a control unit configured to control the movement mechanism so as to execute the moving operation in a case where a toner remaining amount of the toner container is less than a predetermined amount and the opening/closing member is at the open position and so as not to execute the moving operation in a case where the opening/closing member is at the closed position and in a case where the toner remaining amount of the toner container is larger than the predetermined amount.

11. The image forming apparatus according to claim 10, wherein the image forming unit, the toner container, and the opening portion are one of a plurality of image forming units, one of a plurality of toner containers, and one of a plurality of opening portions, respectively, and wherein the opening/closing member opens all of the plurality of opening portions in a case where the opening/closing member is at the open position, and closes all of the plurality of opening portions in a case where the opening/closing member is at the closed position.

12. The image forming apparatus according to claim 10, wherein the movement mechanism includes an urging member configured to apply an urging force to the toner container for moving the toner container in the detachment direction, and a restriction member configured to move between a restriction position for restricting movement of the toner container in the detachment direction, and a permission position for permitting the movement of the toner container in the detachment direction, and wherein the moving operation is an operation for moving the restriction member from the restriction position to the permission position and moving the toner container from the first position to the second position by using the urging force.

13. The image forming apparatus according to claim 12, wherein the toner container includes an engaged portion, and wherein the restriction member is configured to move, between the restriction position and the permission position, in a direction intersecting the detachment direction and has an engaging portion, the engaging portion of the restriction member being configured to restrict, at the restriction position, movement of the toner container in the detachment direction by engaging with the engaged portion of the toner container, the engaging portion of the restriction member being configured to permit, at the permission position, the movement of the toner container in the detachment direction by being away from the engaged portion of the toner container.

14. The image forming apparatus according to claim 10, wherein the control unit controls the movement mechanism to move the toner container from the first position to the second position after a predetermined time upon the detection unit detecting that the opening/closing member is at the open position, in a case where the first condition and the second condition are satisfied.

15. The image forming apparatus according to claim 10, wherein the toner container has a handle, wherein the handle is not exposed from the main body in a case where the toner container is at the first position and the opening/closing member is at the open position, and wherein the handle is exposed from the main body in a case where the toner container is at the second position and the opening/closing member is at the open position.

* * * * *